United States Patent [19]

Zoephel et al.

[11] 4,000,521

[45] Jan. 4, 1977

[54] DISPOSABLE GARMENT AND METHOD

[75] Inventors: Richard L. Zoephel, Lake Villa; James H. Bolker, Barrington, both of Ill.

[73] Assignee: The Kendall Company, Boston, Mass.

[22] Filed: Nov. 5, 1975

[21] Appl. No.: 628,852

[52] U.S. Cl. ..... 2/114; 2/DIG. 7

[51] Int. Cl.[2] ..... A41D 9/00

[58] Field of Search ..... 2/46, 48, 51, 59, 69, 2/69.5, 74, 83, 108, 114, 243 R, 243 B, DIG. 7

[56] References Cited

UNITED STATES PATENTS

| | | | |
|---|---|---|---|
| 3,424,153 | 1/1969 | Lewis, Jr. | 128/132 D |
| 3,570,012 | 3/1971 | Winters | 2/114 |
| 3,648,290 | 3/1972 | Hartigan | 2/114 |
| 3,721,999 | 3/1973 | Goya et al. | 2/114 |
| 3,754,284 | 8/1973 | Hartigan et al. | 2/114 |
| 3,843,971 | 10/1974 | Delanty et al. | 2/114 |
| 3,889,667 | 6/1975 | Collins | 128/132 D |

FOREIGN PATENTS OR APPLICATIONS

| | | | |
|---|---|---|---|
| 21,437 | 11/1895 | United Kingdom | 2/87 |

OTHER PUBLICATIONS

"Over 10,000 Times a Day", P.N.R. No. 1140, 8/14/72.

*Primary Examiner*—Werner H. Schroeder
*Assistant Examiner*—Moshe I. Cohen
*Attorney, Agent, or Firm*—Powell L. Sprunger

[57] ABSTRACT

A sterile disposable garment comprising, a gown having a back, a front, and a pair of side margins adjacent side edges of the gown. The gown has strap means extending from the gown adjacent one of the side margins and defining an opening to receive the wearer's arm and retain the one side margin in position on the wearer while passing the remainder of the gown around the wearer.

30 Claims, 9 Drawing Figures

Fig. 1
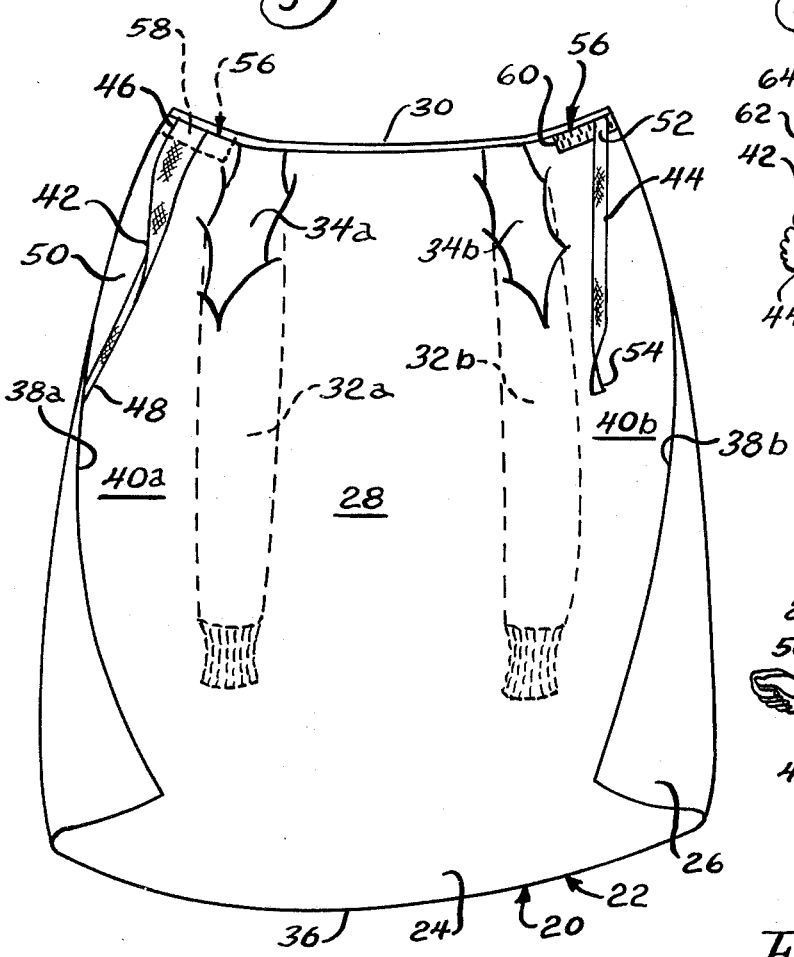
Fig. 2
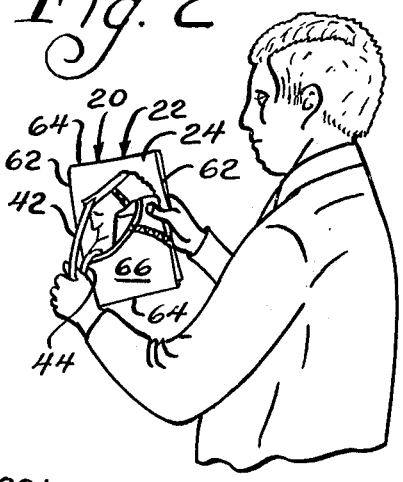
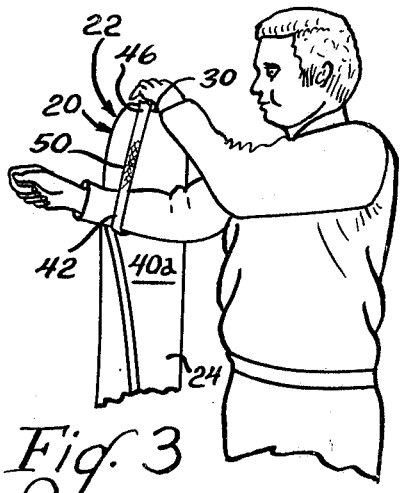
Fig. 3
Fig. 4
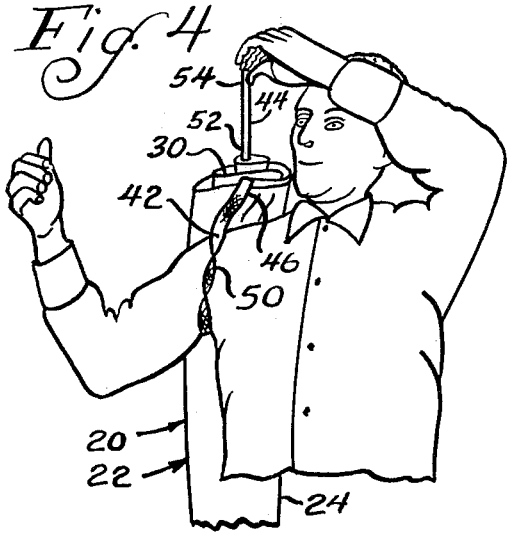
Fig. 5
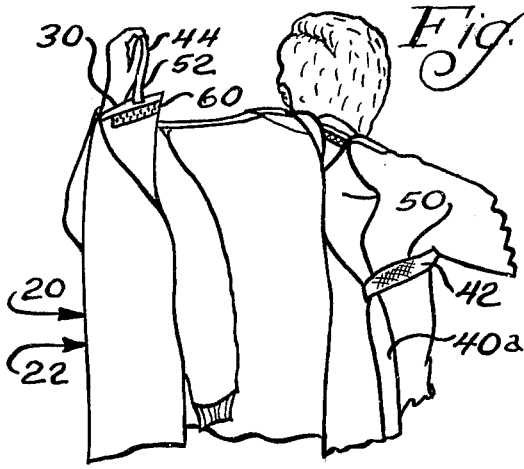

Fig. 6
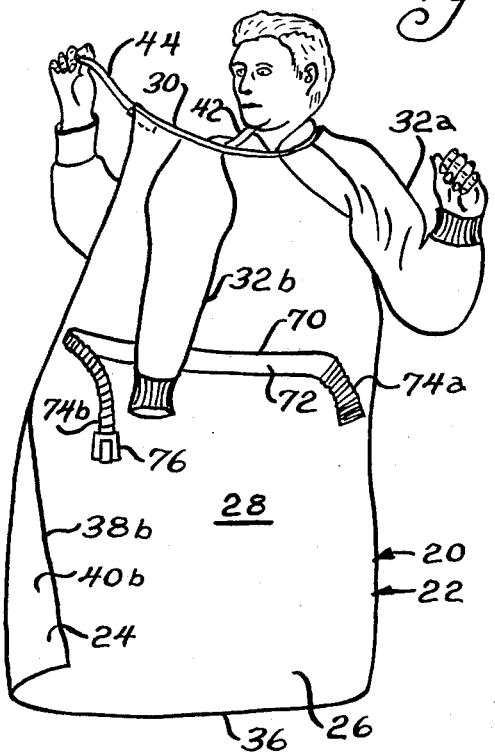
Fig. 7
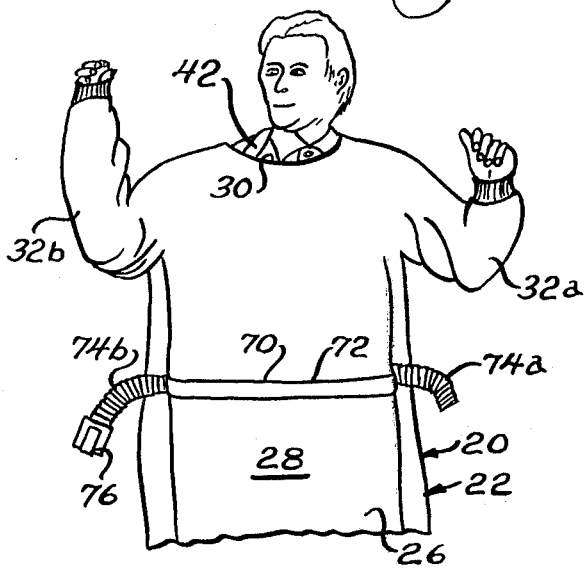
Fig. 8
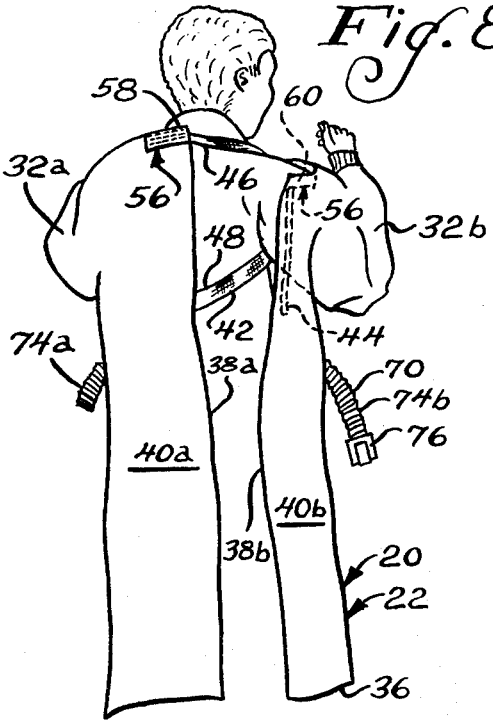
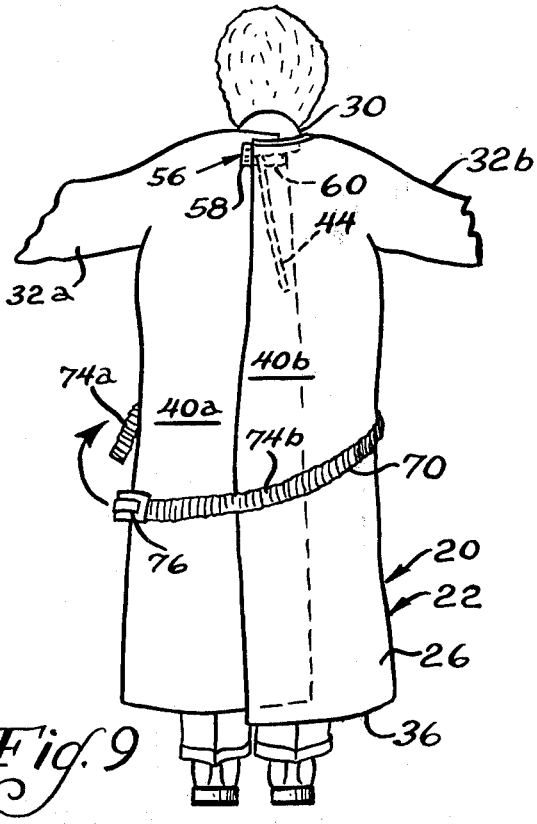
Fig. 9

DISPOSABLE GARMENT AND METHOD

BACKGROUND OF THE INVENTION

The present invention relates to garments, and more particularly to disposable gowns.

In recent years, gowns of the disposable type have come into widespread use due to convenience since they may be discarded after a single use and need not be laundered. Such gowns may be utilized for a number of different purposes, but have been found particularly useful in a hospital operating room. Of course, when worn in the operating room, the gowns must be sterile to prevent possible contamination to the patient during the operation. In a preferred form, the backs of the gowns below the gown neck should be maintained in a sterile condition, since the wearer of one gown may back into the gown front of an associate. If the gown back of the first person has been contaminated, such a collision may result in contamination of the associate's gown front, and the associate's contaminated gown poses a danger to the patient during the operation.

In the past, most of the sterile-back gowns have required a second person to close the gown back by such closures as internal ties in the gown. In the case of a surgical gown, the back flaps of the gown are normally closed by a non-sterile circulating nurse who finds it virtually impossible to insure that the back of the gown has not been contaminated while being closed, due to the nature of the gown closures.

SUMMARY OF THE INVENTION

A principal feature of the present invention is the provision of a sterile disposable garment which may be closed in a simplified and aseptic manner.

In a preferred form, the disposable garment comprises, a gown having an inner surface, an outer surface, a front, a neck, a pair of sleeves adjacent sides of the gown front, and a pair of side edges defining a pair of back flaps extending from opposed sides of the gown front for covering the back of the wearer. The gown has a strap having an upper end secured to one of the back flaps adjacent the juncture of the gown neck and the side edge defining the one back flap. The strap has a lower end secured to the one back flap adjacent the side edge defining the one back flap and at a location spaced a sufficient distance below the gown neck to define an arm opening between the strap and gown. The gown has an elongated assist tab having an end secured to the other of the back flaps adjacent the juncture of the gown neck and the side edge defining the other back flap. The gown is folded into a configuration with the inner surface of the gown exposed, and with the strap and assist tab being exposed from the folded gown.

A feature of the present invention is that the wearer may grasp the folded gown without touching and contaminating the outside of the gown.

Another feature of the invention is that the wearer may insert an arm through the opening defined by the strap in the folded gown.

A further feature of the invention is that the wearer may grasp the assist tab in the folded gown and permit the gown to be partially unfolded without contaminating the gown.

Yet another feature of the invention is that the wearer may pass the gown around the body through use of the assist tab without contaminating the gown.

Still another feature of the invention is that the strap retains the one back flap in position on the back of the wearer while the gown is being passed around the wearer.

A feature of the invention is that the assist tab may be held by the wearer while inserting the arms into the sleeves.

Thus, a feature of the present invention is that the gown may be substantially placed on the wearer without assistance while preventing contamination of the gown.

A further feature of the invention is the provision of means for securing portions of the neck on the back flaps together.

A feature of the present invention is the provision of a method for securing the back flap of the sterile gown on the wearer.

Yet another feature of the present invention is the provision of a method for placing the disposable gown on the wearer in an aseptic manner.

Further features will become more fully apparent in the following description of the embodiments of this invention and from the appended claims.

DESCRIPTION OF THE DRAWINGS

In the drawings:

FIG. 1 is an elevational view of a sterile disposable garment of the present invention taken from the inside of the garment;

FIG. 2 is a perspective view showing the garment of FIG. 1 in a folded configuration;

FIG. 3 is a fragmentary perspective view showing a wearer inserting an arm into an opening defined by a strap in the garment; and FIGS. 4–9 are perspective views illustrating placement of the garment on the wearer.

DESCRIPTION OF THE PREFERRED EMBODIMENTS

Referring now to FIG. 1, there is shown a disposable garment 20 comprising a sterile disposable gown generally designated 22 of the type having a sterile back below the gown neck during use of the gown. The gown 22 has an inner surface 24 for facing the wearer when the gown is worn, an outer surface 26 facing away from the wearer when the gown is worn, a front 28 for covering the front of the wearer, a neck 30, and a pair of sleeves **32*a* and 32*b* defining respective sleeve openings 34*a* and 34*b* on the inside of the gown to receive the wearer's arms during placement of the gown. The gown 22 has a bottom edge 36, and a pair of side edges 38*a* and 38*b* extending between the neck 30 and bottom edge 36 of the gown 22. The side edges 38*a* and *b*, respectively, define a pair of back flaps 40*a* and 40*b* of the gown which extend from opposed sides of the gown front 28 toward the side edges 38*a* and *b* of the gown 22**.

The gown 22 has an elongated retaining strap 42 associated with the back flap **40*a* of the gown 22, and an elongated assist tab 44 associated with the other back flap 40*b* of the gown 22. Although for convenience of discussion the retaining strap 42 will be discussed for use in connection with the left back flap 40*a* of the gown and the assist tab 44 will be discussed in connection with the right back flap 40*b* of the gown, it will be understood as the discussion proceeds that the retaining strap 42 and assist tab 44** may be associated with the opposite back flaps of the gown.

In a preferred form, the retaining strap 42 has an upper end 46 secured to the inside of the gown adjacent the juncture of the side edge 38*a* and the neck 30 of the gown. The retaining strap 42 also has a lower end 48 secured to the inside of the back flap 40*a* adjacent the side edge 38*a*. As shown, the lower end 48 of the strap 42 is secured to the gown at a location spaced a sufficient distance below the neck 30 to define an opening 50 between the strap 42 and the back flap 40*a* which is large enough to receive an arm of the wearer. The retaining or shoulder strap 42 may be made of any suitable material, such as plastic or a nonwoven material, and in a preferred embodiment may be made from an elastic fabric.

The assist tab 44 has one end 52 secured to the inside of the gown adjacent the juncture of the neck 30 and the side edge 38*b*. The tab 44 also has a second end 54 spaced from the end 52 which may be grasped by the wearer during placement of the gown, as will be described below.

The gown 22 also has securing means 56 for fastening neck portions of the back flaps 40*a* and *b* together during placement of the gown. The securing means 56 may have a first fastening element 58 secured to the outside of the back flap 40*a* adjacent the juncture of the neck 30 and the side edge 38*a* of the gown. The securing means 56 also has a second fastening element 60 secured to the inside of the back flap 40*b* adjacent the juncture of the neck 30 and the side edge 38*b* of the gown, such that the second fastening element 60 is located adjacent the one end 52 of the assist tab 44. In a convenient form, the first and second fastening elements 58 and 60 may comprise hook and loop fastening strips of a known type which are secured to the gown.

With reference to FIGS. 1 and 2, the gown 22 is folded along a plurality of longitudinally extending fold lines 62, which are generally parallel to the side edges 38*a* and *b*, in a manner such that the outer surface 26 is folded inside the gown and the inner surface 24 is exposed outside the longitudinally folded gown. Next, the longitudinally folded gown is laterally folded along a plurality of lateral fold lines 64 defining a folded configuration of the gown 22 having an upper panel 66 containing the retaining strap 42 and assist tab 44 exposed on the outside of the folded gown, as shown in FIG. 2. The laterally folded gown 22 only has its inner surface 24 exposed outside the gown.

With reference to FIG. 2, the wearer, such as a surgeon, may pick up the folded gown 22 from its package while only contacting the inner surface 24 of the gown, thus preventing contamination to the outer surface of the gown. The wearer may grasp the assist tab 44 and neck 30 of the gown while permitting the gown 22 to laterally unfold, as shown in FIGS. 2 and 3. Since only the inner surface 24 of the gown 22 is exposed in the longitudinally folded gown, the gown is not contaminated during this unfolding procedure.

As illustrated in FIG. 3, the wearer then inserts his right arm through the opening 50 defined by the strap 42 and back flap 40*a* while releasing the gown and holding the assist tab 44 with his left hand. Referring to FIGS. 4 and 5, the wearer next passes the gown 22 around his back while longitudinally unfolding the gown through use of the assist tab 44. As best shown in FIG. 5, the strap 42 passes around the wearer's shoulder and retains the left back flap 40*a* in proper position on the back of the wearer while the gown is being unfolded. Referring to FIG. 6, the wearer grasps the assist tab 44 with his right hand and passes the gown 22 around the front of his body through use of the tab 44, such that the front 28 of the gown 22 is placed in front of his body in order to expose the openings of the sleeves 32*a* and 32*b*. The wearer then inserts his left arm into the left sleeve 32*a* while retaining the assist tab 44 in his right hand. Next, the wearer may grasp the assist tab 44 with his left hand while inserting the right arm into the right sleeve 32*b*, as shown in FIG. 7, after which the wearer releases his hold on the tab 44 causing the tab to fall beneath the right back flap. Referring to FIGS. 7 and 8, at this point in the donning procedure, the left back flap 40*a* of the gown 22 is retained by the strap 42 at its proper position on the back of the wearer, while the right back flap 40*b* of the gown has been partially brought around the back of the wearer.

With reference to FIGS. 8 and 9, the nurse may grasp the gown neck 30, which is considered a non-sterile area of the gown due to the wearer's hair, and bring the back flap 40*b* of the gown into an overlying relationship with the other back flap 40*a*. The nurse then presses the fastening element 60 against the fastening element 58 to secure the neck portions of the back flaps together. At this time, the side margin of the back flap 40*b* covers a side margin of the flap 40*a*, thus closing the back of the gown, as shown in FIG. 9.

As shown in FIGS. 6–8, the gown 22 may have a belt 70 having a central portion 72 secured to a longitudinal medial portion of the gown, and a pair of end sections 74*a* and 74*b* extending from opposed ends of the central portion 72. The belt 70 also has a protective cover 76 covering an end portion of the belt end section 74*b*. With reference to FIG. 9, after the first and second fastening elements 58 and 60 have been secured together, the wearer may don a pair of sterile surgical gloves. Next, the nurse may grasp the cover 76 in order to bring the belt end section 74*b* around the front of the gown, after which the wearer grasps the belt end sections 74*a* and *b* while the nurse removes the cover 76 from the end section 74*b*. The wearer may then tie the sterile belt end sections 74*a* and *b* in order to retain the longitudinal medial portion of the back flaps 40*a* and 40*b* together during use of the gown.

According to a method of the present invention, the back flap of the gown is secured on the wearer by passing an arm of the wearer through an opening defined by the strap on the gown to retain one side of the back flap against the wearer's back. The other arm of the wearer is placed in a sleeve adjacent the other side of the back flap. According to another method of the present invention, the gown is placed on the wearer by securing a first back flap of the gown on an arm of the wearer prior to placement of the arm into the gown sleeve. The remainder of the gown is passed around the wearer's body while inserting both arms into the pair of sleeves, and a second back flap of the gown is secured to the first back flap to close the back of the gown.

The foregoing detailed description is given for clearness of understanding only, and no unnecessary limitations should be understood therefrom, as modifications will be obvious to those skilled in the art.

We claim:

1. A sterile disposable garment comprising, a gown having a back, a front, a pair of side margins adjacent side edges of the gown, a pair of sleeves, and strap means extending from the gown adjacent one of said side margins and defining an opening to receive the wearer's arm and retain said one side margin in position on the wearer while passing the remainder of the gown around the wearer.

2. The garment of claim 1 including tab means extending from the other of said gown side margins to facilitate movement of said gown around the wearer.

3. The garment of claim 1 wherein said gown has a plurality of folds defining a folded configuration of the gown with an interior surface of the gown being exposed outside the folded gown.

4. The garment of claim 3 wherein at least a portion of said strap means is exposed outside the folded gown.

5. The garment of claim 2 wherein said gown has a plurality of folds defining a folded configuration of the gown with an interior surface of the gown being exposed outside the folded gown, and in which at least a portion of said tab means is exposed outside the folded gown.

6. The garment of claim 3 wherein the gown has a plurality of longitudinally extending folds exposing the interior surface of the gown, and a plurality of lateral folds of the longitudinally folded gown defining a panel containing an upper portion of the gown.

7. A sterile disposable garment comprising, a gown having an inner surface, an outer surface, a front, a neck, a pair of side edges defining a pair of back flaps extending from opposed sides of the gown front for covering the back of the wearer, a pair of sleeves, and a strap having a portion retained on one of said back flaps and defining an opening to receive an arm of the wearer and retain said one back flap in position on the wearer.

8. The garment of claim 7 wherein said strap comprises an elastic band.

9. The garment of claim 7 wherein said strap is secured to the inner surface of the gown.

10. The garment of claim 7 wherein said strap has a pair of ends secured to spaced portions of said one back flap.

11. The garment of claim 7 wherein said strap has an upper end secured to said one back flap adjacent the neck of the gown.

12. The garment of claim 11 wherein said upper strap end is secured to the gown adjacent the side edge defining said one back flap.

13. The garment of claim 7 wherein said strap has a lower end secured to said one back flap at a location spaced a distance below the gown neck.

14. The garment of claim 13 wherein said lower strap end is secured to the gown adjacent the side edge defining said one back flap.

15. The garment of claim 7 including tab means having a portion retained on the other of said back flaps to facilitate placement of the gown on the wearer.

16. The garment of claim 15 wherein said tab means comprises an elongated band having one end secured to the gown.

17. The garment of claim 15 wherein said tab means is secured to the neck of the gown.

18. The garment of claim 15 wherein said tab means is secured to the gown adjacent the side edge defining said other back flap.

19. The garment of claim 15 wherein said tab means is secured to the inside of the gown.

20. The garment of claim 7 including a belt retained on the gown for closing a longitudinal medial portion of said back flaps.

21. The garment of claim 7 including means for securing portions of the back flaps together adjacent the gown neck.

22. The garment of claim 21 wherein the securing means comprises, first fastening means on the outside of said one back flap adjacent the gown neck, and second fastening means engageable with the first fastening means and positioned on the inside of the other of said back flaps adjacent the neck of the gown.

23. The garment of claim 22 wherein the first and second fastening means comprise a pair of hook and loop fastening strips.

24. The garment of claim 22 including tab means having a portion retained on the other of said back flaps to facilitate placement of the gown on the wearer, and wherein said tab means is secured to the gown adjacent the second fastening means.

25. A sterile disposable garment comprising, a gown having an inner surface, an outer surface, a front, a neck, a pair of sleeves adjacent sides of the gown front, a pair of side edges defining a pair of back flaps extending from opposed sides of the gown front for covering the back of the wearer, a strap having an upper end secured to one of said back flaps adjacent the juncture of the gown neck and the side edge defining said one back flap, said strap having a lower end secured to said one back flap adjacent the side edge defining said one back flap and at a location spaced a sufficient distance below the gown neck to define an opening between the strap and gown for receiving an arm of the wearer, and said gown having an elongated assist tab having an end secured to the other of said back flaps adjacent the juncture of the gown neck and the side edge defining said other back flap, said assist tab facilitating placement of the gown about the wearer after the wearer's arm has been received in said opening.

26. The garment of claim 25 including means for securing portions of the back flaps together comprising, a first fastening element secured to the outside of said one back flap adjacent the juncture of the gown neck and the side edge defining said one back flap, and a second fastening element interengageable with the first element and secured to the inside of said other back flap adjacent the juncture of the gown neck and the side edge defining said other back flap.

27. A method of securing a back flap of a sterile, disposable, open-back gown having a pair of sleeves on a wearer, comprising the steps of:

passing a first arm of the wearer through an opening defined by a strap on the gown to retain one side of the back flap against the wearer's back;

placing the other arm of the wearer in a sleeve adjacent the other side of the back flap; and placing said first arm in the other sleeve.

28. A method of placing a sterile disposable gown of the open-back type on a wearer, comprising the steps of:

securing a first back flap of the gown on an arm of the wearer prior to placement of the arm into a sleeve of the gown;

passing the remainder of the gown around the wearer's body while inserting both arms into a pair of sleeves on the gown; and securing a second back flap of the gown to the first back flap to close the back of the gown.

29. The method of claim 28 wherein said first securing step comprises the step of inserting the wearer's arm through an opening defined by a strap associated with the first back flap.

30. The method of claim 28 wherein said passing step includes the steps of grasping a tab associated with the second back flap, and passing the tab at least partially around the wearer's body.

* * * * *